United States Patent [19]

Guth

[11] 4,356,631

[45] Nov. 2, 1982

[54] FOLDABLE PUSH DAGGER

[76] Inventor: Kenneth W. Guth, Box 252A, Saddlewood Dr., Maple Park, Ill. 60151

[21] Appl. No.: 197,282

[22] Filed: Oct. 15, 1980

[51] Int. Cl.[3] ..... B26B 1/04

[52] U.S. Cl. ..... 30/154; 30/152; 30/314

[58] Field of Search ..... 30/152, 154, 155, 158, 30/287, 162, 314

[56] References Cited

U.S. PATENT DOCUMENTS

| | | | |
|---|---|---|---|
| D. 137,451 | 3/1944 | Harstad | 30/287 X |
| 509,819 | 11/1893 | Meerroth | 30/154 X |
| 601,380 | 3/1898 | Phillips | 30/154 X |
| 970,517 | 9/1910 | Lockhart | 30/152 |
| 1,042,952 | 10/1912 | Nies | 30/154 X |
| 1,701,467 | 2/1929 | Tillmanns | 30/154 X |

*Primary Examiner*—Jimmy C. Peters

*Attorney, Agent, or Firm*—Mason, Kolehmainen, Rathburn & Wyss

[57] ABSTRACT

A foldable push dagger includes an elongated, movable, sharpened dagger blade secured to an elongated dagger handle. In a fully closed position, the longitudinal axis of the blade is parallel to the longitudinal axis of the handle such that the blade is disposed entirely within the handle. In a fully opened position, the longitudinal axis of the blade is perpendicular to the longitudinal axis of the handle such that the sharpened portion of the blade is disposed exteriorly of the handle and the push dagger assumes a "T" configuration. In its fully opened position, the blade is releasably secured in the handle against substantial relative movement therewith.

18 Claims, 11 Drawing Figures

FOLDABLE PUSH DAGGER

BACKGROUND OF THE INVENTION

1. Field of the Invention

The device of the present invention generally relates to knives or daggers and, more particularly, to a foldable push dagger.

2. Description of the Prior Art

Push daggers having an elongated, sharpened dagger blade, the longitudinal axis of which is disposed perpendicularly to the longitudinal axis of an elongated dagger handle, are old and well known. Such prior art push daggers typically have a sharpened dagger blade fixedly and immovably secured to the dagger handle approximately midway between the longitudinal ends of the dagger handle in such a manner as to form a "T" configuration. The handle may then be placed in a hand of a user such that the sharpened dagger blade extends outwardly from and between two fingers of the hand of the user.

Such prior art push daggers are relatively awkward and unsafe to handle and store when not in use as daggers. Some such push daggers when not in use as daggers functioned as the handles of canes or of umbrellas, the blades of such push daggers being concealed in the bodies of the canes or umbrellas. A user was thus required to maintain an often large and unwieldy cane or umbrella in his possession in order to experience the comfort, pleasure and security of having the push dagger in his possession.

SUMMARY OF THE INVENTION

An object of the present invention is to provide a new and improved knife.

Another object of the present invention is to provide a new and improved push dagger.

Another object of the present invention is to provide a new and improved foldable push dagger including a handle and a blade movable within the handle such that, in a fully closed position, the sharpened dagger blade is secured entirely within the handle and, in a fully opened position, the sharpened dagger blade is disposed exteriorly of the handle and the dagger assumes a "T" configuration.

Briefly, a new and improved foldable push dagger is disclosed herein and includes an elongated, movable, sharpened dagger blade secured within an elongated dagger handle. The blade has at its first longitudinal end a sharpened dagger blade point and at its second, opposite longitudinal end securing means for retaining the blade in contact with the handle. The second end of the blade is movably positioned within the handle. In a fully closed position, the second end of the blade is disposed generally at one longitudinal end of the handle in such a manner that the blade is retained entirely within the handle and the longitudinal axis of the blade is parallel to the longitudinal axis of the handle. When moved to its fully opened position, the second end of the blade is disposed generally midway along the length of the handle (i.e., half way between the longitudinal ends of the handle) such that the sharpened portion of the blade is disposed exteriorly of the handle and the longitudinal axis of the blade is disposed generally perpendicularly to the longitudinal axis of the handle. In its fully opened position, the blade securing means referred to above releasably engages and interlocks with the handle to prevent substantial relatively movement between the blade and the handle and to maintain the dagger in a "T" configuration. In its fully opened position, the handle may be grasped by a hand of a user in such a manner that the blade is between and extends outwardly from two adjacent fingers of the hand of the user. The blade may be released from its fully opened position and moved to its fully closed position within the handle for safe and convenient storage or handling.

BRIEF DESCRIPTION OF THE DRAWING

The above and other objects and advantages and novel features of the present invention will become apparent from the following detailed description of a preferred embodiment of the present invention illustrated in the accompanying drawing wherein.

DESCRIPTION OF THE PREFERRED EMBODIMENT

Figure 1:
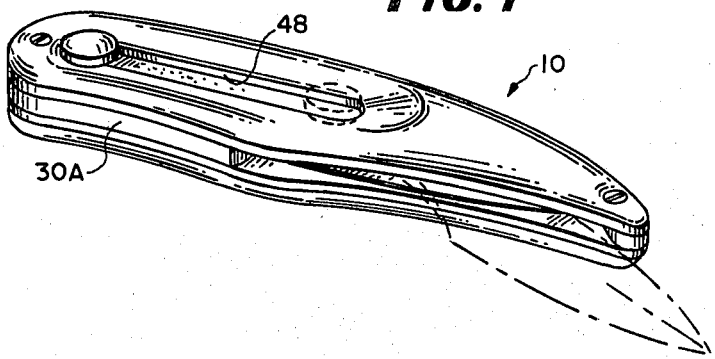
FIG. 1 is a perspective view of an inventive foldable push dagger in its fully closed position constructed in accordance with the principles of the present invention.
Figure 2:
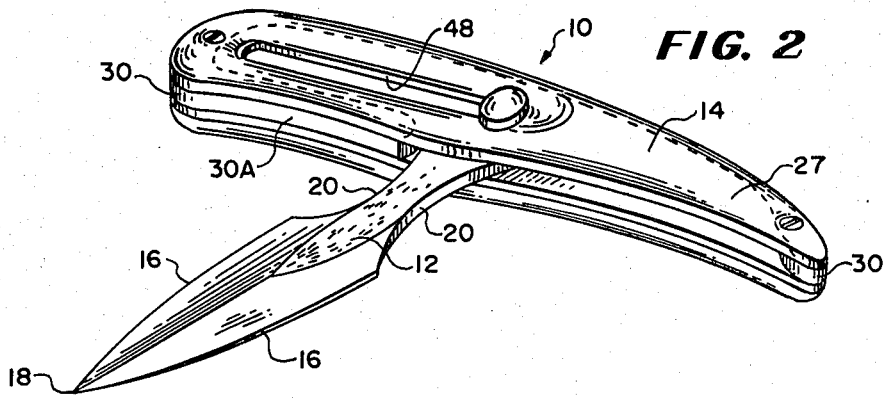
FIG. 2 is a perspective view of the push dagger of FIG. 1 in its fully opened position.
Figure 3:
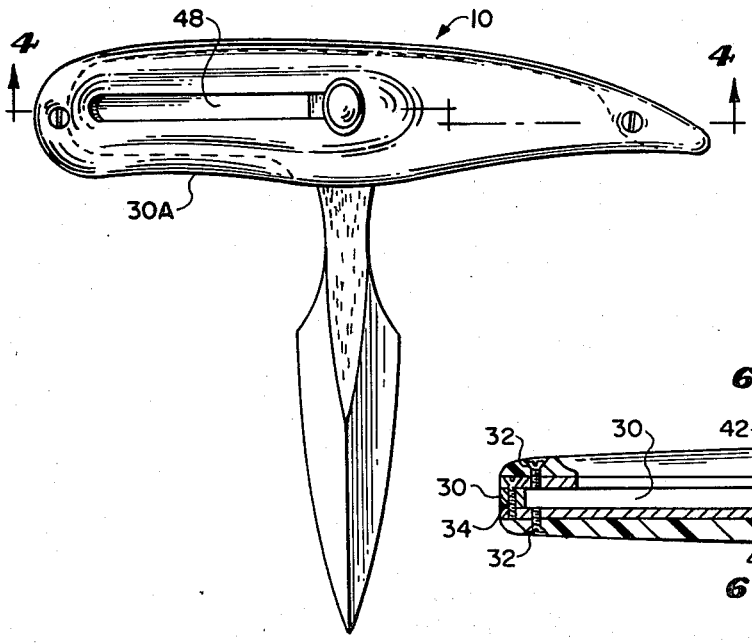
FIG. 3 is a top plan view of the push dagger of FIG. 2.

In accordance with an important feature of the present invention, a new and improved knife or push dagger 10 (FIGS. 1–7) includes an elongated, movable, generally planar, sharpened knife or dagger blade 12 and an elongated knife or dagger handle 14. In accordance with an important feature of the present invention, the blade 12 is movable from a fully closed position (as depicted in solid lines in FIGS. 1 and 5) to a fully opened position (as depicted in FIGS. 2–4, 6 and 7). When the push dagger 10 is in its fully closed position, the longitudinal axis of the blade 12 is parallel to the longitudinal axis of the handle 14 and the blade 12 and the handle 14 form an "I" configuration. In its fully opened position, the longitudinal axis of the blade 12 is perpendicular or transverse to the longitudinal axis of the handle 14. In its fully opened position, the blade 12 and the handle 14 form a "T" configuration with the blade 12 forming the vertical stem of the "T" configuration and the handle 14 forming the top or cross or horizontal portion of the "T" configuration.

The blade 12 has sharpened edges 16 of a continuous curvature that extend along a substantial portion of the length of the blade 12, that is, more than fifty percent of the length of the blade 12, and that forwardly converge to form a sharpened dagger point 18 at a first longitudinal end of the blade 12. Rearwardly of the sharpened edges 16 (FIGS. 2 and 3) are unsharpened, curved or contoured portions 20 that extend to the second longitudinal or opposite end 22 of the blade 12.

Figure 4:
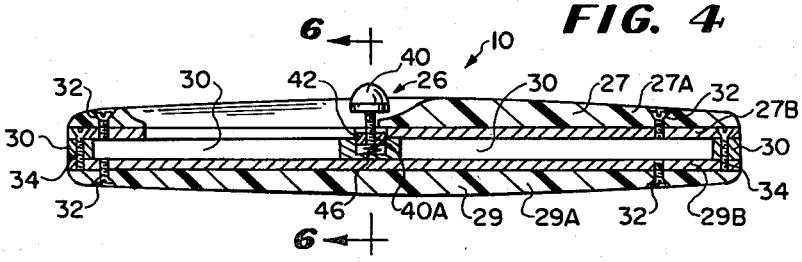
FIG. 4 is a cross-sectional view of the push dagger taken along line 4—4 of FIG. 3.
Figure 5:
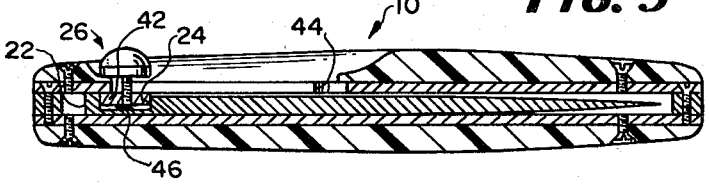
FIG. 5 is a cross-sectional view similar to the view of FIG. 4 depicting the push dagger in its fully closed position.
Figure 6:
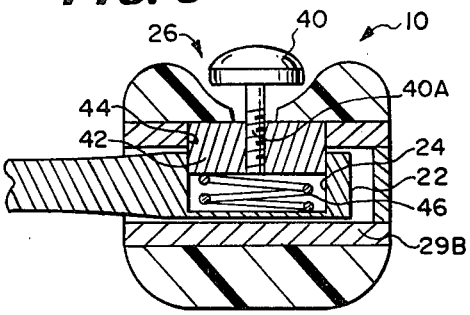
FIG. 6 is an enlarged, fragmentary, cross-sectional view of a portion of the push dagger of FIGS. 2–4 taken along line 6—6 of FIG. 4.
Figure 7:
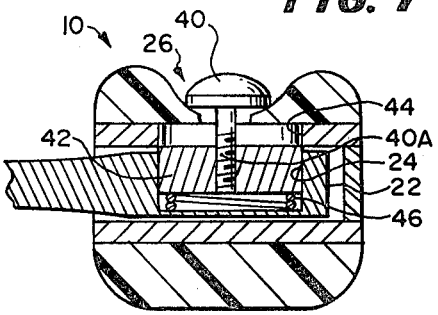
FIG. 7 is an enlarged, fragmentary, cross-sectional view of the same portion of the foldable push dagger illustrated in FIG. 6.

At the second end 22, an aperture or recess 24 (FIGS. 5–7) is formed in the blade 12 for the receipt of and the retention of means 26 for moving the blade 12 and for releasably securing the blade 12 in its fully opened position such that there is no substantial relative movement between the blade 12 and the handle 14. The handle 14 includes an elongated upper portion 27 separated from an elongated lower portion 29 by a suitably configured spacing member 30. The spacing member 30 is generally of a "J" configuration (as depicted in dotted line form in FIG. 3) and serves both to close both the back side or periphery of the push dagger 10 (FIGS. 3 and 4) and a portion of the front side or periphery of the push dagger 10 (FIGS. 1–3) and to guide and retain the contoured portions 20 of the blade 10 when the blade 10 is being moved from its fully opened position (FIGS. 2 and 3) to its fully closed position (FIG. 1). In its fully closed position, the blade 12 is retained in the handle 14 by the front peripheral portion 30A of the spacing member 30 that bears against an adjacent portion 20 of the blade 12. As depicted in FIGS. 1–7, the upper portion 27 and the lower portion 29 are formed as composite structures of exterior portions 27A and 29A, respectively, secured by suitable fasteners, such as a plurality of screws 32, to interior portions 27B and 29B, respectively. As depicted in FIGS. 4 and 5, prior to the interconnection of the exterior portions 27A and 29A to the interior portions 27B and 29B, respectively, the interior portions 27B and 29B may be secured to the spacing member 30 by suitable fastening means, such as a plurality of screws 34. Obviously, in an alternate embodiment of the present invention, rather than being formed as composite structures, one or both of the upper portion 27 and the lower portion 29 may be formed as unitary members. In addition, the spacing member 30 may be formed as an integral portion of either the upper portion 27 or the lower portion 29. The components of the push dagger 10 may be formed from any suitable materials that are well known to those of ordinary skill in the art. For example, the blade 12 may be made of hardened steel; the exterior portion 27A of the upper portion 27 and the exterior portion 29A of the lower portion 29 of the handle 14 may be made of metal, bone, ivory, plastic or plastic laminae; and the interior portion 27B of the upper portion 27 and the interior portion 29B of the lower portion 29 of the handle 14 and the spacing member 30 may be made of metal, such as hardened steel.

In accordance with an important feature of the present invention, the moving and securing means 26 includes a locking and release button 40 that has an integrally formed, elongated, threaded stem 40A for fixedly engaging a mating, threaded aperture in a movable, retangularly-shaped, spring biased, locking plate 42. The configuration of the locking plate 42 is such as to be releasably received within and securely retained within a complimentarily shaped locking recess 44, formed with a mating rectangular configuration in the interior portion 27B of the upper portion 27 of the handle 14, when the blade 12 is in its fully opened position (FIGS. 2–4, 6 and 7). The moving and securing means 26 further includes spring biasing means 46 (which in the embodiment of FIGS. 1–7 comprises a coiled spring) for biasing the plate 42 into the recess 44 when the blade 12 is in its fully opened position. Preferably, the tolerances between the mating portions of the recess 44 and the plate 42 should be maintained relatively small in order to prevent substantial relative movement between the blade 12 and the handle 14 when the blade 12 is in its fully opened position.

In order to release the blade 12 from its fully opened position (FIGS. 2–4 and 6), the button 40 is manually depressed (FIG. 7) to disengage the plate 42 from the recess 44 and to thereby permit the subsequent movement of the blade 12 to its fully closed position within the handle 14 (FIGS. 1 and 5). In moving the blade 12 to its fully closed position from its fully opened position, the button 40 is depressed and the blade 12 is initially rotated about an axis of rotation substantially coincident with the longitudinal axis of the stem 40A until the edge 16 of the blade 12 engages the spacing member 30 (as depicted in dotted line form in FIG. 1). In this position, the blade 12 may be moved to its fully closed position by manually moving the button 40 along an elongated slot 48 formed in the upper portion 27 of the handle 14 from its position depicted in FIGS. 2–4 (and in dotted line form in FIG. 1) to its position depicted in FIGS. 1 and 5. When the button 40 is in its position depicted in FIGS. 1 and 5, the blade 12 is in its fully closed position and is disposed entirely within the handle 14. The blade 12 is guided within and retained within the handle 14 by the contacting engagement of the contoured portion 20 of the blade 12 with the adjacent contoured portion 30A of the spacing member 30. When the blade 12 is in its fully closed position, the push dagger 10 is in a condition and safe and convenient storage or further handling.

Figure 11:
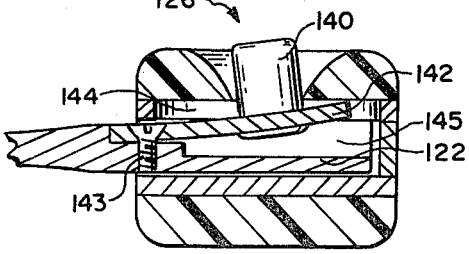
FIG. 11 is an enlarged, fragmentary, cross-sectional view of a portion of the push dagger of FIG. 8 taken along line 11—11 of FIG. 9.

In accordance with an alternate embodiment of the present invention (FIGS. 8–11), a knife or push dagger 110 includes an elongated, movable, sharpened knife or dagger blade 112 and an elongated knife or dagger handle 114 that function in substantially the same manner as the corresponding portions of the embodiment of the present invention described hereinabove with respect to FIGS. 1–7. The major differences between the push dagger 10 (FIGS. 1–7) and the push dagger 110 (FIGS. 8–11) are the slightly different configurations of the handles 14 and 114; the use of a single set of three screws 134 to interconnect the upper portion 127, the lower portion 129 and the spacing member 130; and a modified means 126 for moving the blade 112 and for releasably securing the blade 112 in its fully opened condition (FIG. 11).

Figure 8:
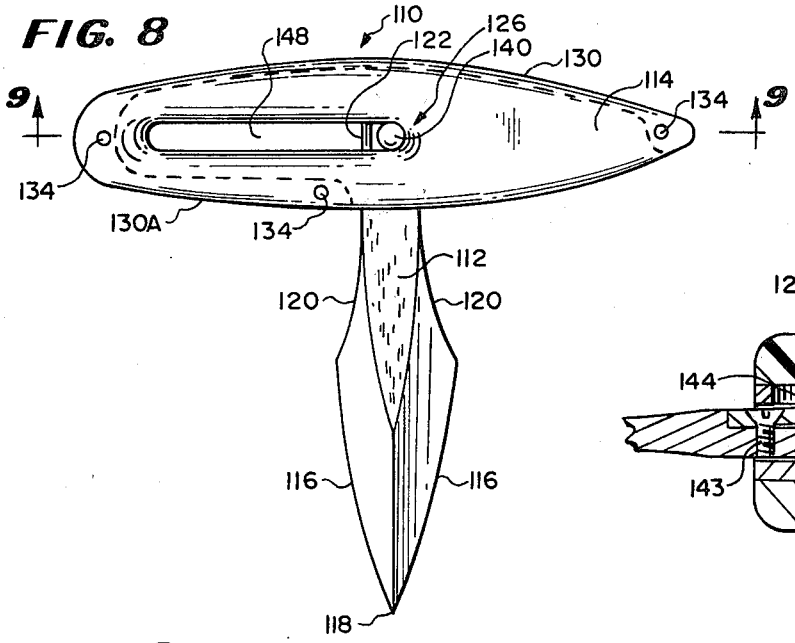
FIG. 8 is a top plan view of an alternate embodiment of the inventive foldable push dagger constructed in accordance with the principles of the present invention.
Figure 9:
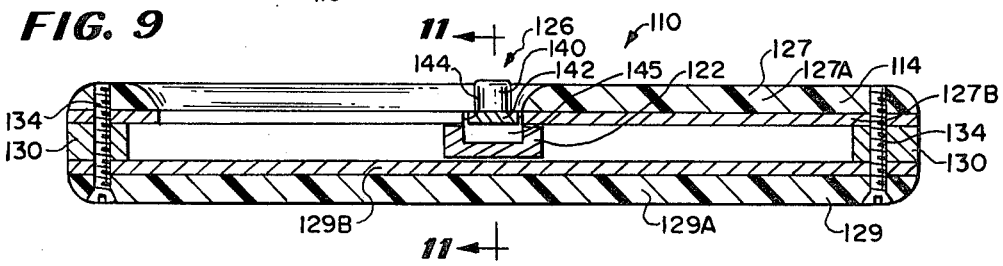
FIG. 9 is a cross-sectional view of the push dagger of FIG. 8 taken along line 9—9 of FIG. 8.
Figure 10:
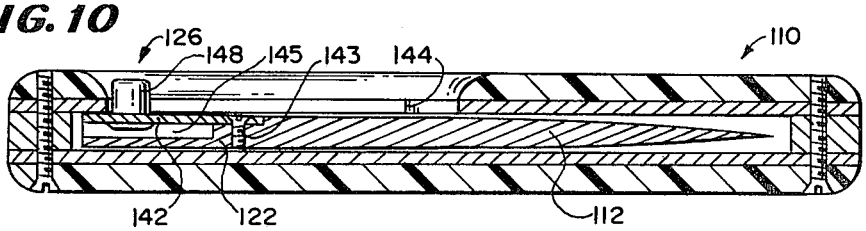
FIG. 10 is a cross-sectional view of the push dagger of FIG. 8 in its fully closed position.

More specifically, the moving and securing means 126 includes a locking and release button 140 fixedly secured to a movable cantilever spring locking plate 142 secured by any suitable means, such as a screw 143, to the blade 112. A longitudinal end 122 of the blade 112 is formed in the configuration of a stepped, U-shaped channel 145 (FIGS. 9–11) in order to provide room for movement of the plate 142. The configuration of the plate 142 is such as to be releasably received within and securely retained within a locking recess 144 formed in the interior portion 127B of the upper portion 127 of the handle 114 when the blade 112 is in its fully opened position (FIGS. 8 and 9). Preferably the tolerances between the mating portions of the recess 144 and the plate 142 should be maintained relatively small in order to prevent substantial relative movement between the blade 112 and the handle 114 when the blade 112 is in its fully opened position.

In order to release the blade 112 from its fully opened position, the button 140 (FIGS. 9 and 11) is manually depressed to compress the cantilever spring locking plate 142 and thereby disengage the plate 142 from the recess 144. The blade 112 may then be rotated about the longitudinal axis of the button 140 (FIG. 8) and subsequently moved to its fully closed position (FIG. 10) by manually moving the button 140 along the slot 148 from the position of the button 140 depicted in FIG. 8 to the position of the button 140 depicted in FIG. 10. The plate 142, depicted in FIG. 10 in its compressed condition and in FIGS. 9 and 11 in its released condition, may be formed of any suiable material, such as spring steel, provided that the material selected has sufficient elasticity to permit the plate 142 to function as a cantilever spring.

Obviously, many modifications and variations of the present invention are possible in light of the above teachings. Thus, it is to be understood that, within the scope of the appended claims, the invention may be practiced otherwise and as specifically described hereinabove.

What is claimed and desired to be secured by Letters Patent of the United States is:

1. A push dagger comprising an elongated, movable, dagger blade having two, oppositely disposed, elongated, sharpened edges extending along a substantial portion of the length of said blade, said two edges converging at a first longitudinal end of said blade to form a sharpened dagger point at said first longitudinal end of said blade, an elongated dagger handle having first and second, oppositely disposed longitudinal ends, said blade having a fully opened position in which at least a portion of said blade is disposed exteriorly of said handle and a different fully closed position in which at least a major portion of said blade is disposed within said handle, and means disposed at a second longitudinal end of said blade opposite from said first longitudinal end of said blade for interconnecting said blade and said handle and for enabling relative movement between said blade and said handle along the length of said handle during the movement of said blade from said fully opened position to said fully closed position, said second longitudinal end of said blade being disposed at a first longitudinal end of said handle when said blade is in said fully closed position and being disposed along the length of said handle at a position intermediate said first and second longitudinal ends of said handle when said blade is in said fully opened position, said interconnecting means comprising manually engageable means for moving said blade and for releasably securing said blade in its fully opened position, said manually engageable means including a movable locking member movable relative to said blade and having an outer peripheral configuration, said handle including interlocking means for releasably receiving and securely retaining said locking member in engagement therewith when said blade is in its fully opened position, said interlocking means having an inner peripheral configuration complementarily shaped to said outer peripheral configuration of said locking member to prevent substantial relative movement between said blade and said handle when said blade is in its fully opened position.

2. A push dagger as recited in claim 1 wherein said interlocking means comprises a recess formed in said handle.

3. A push dagger as recited in claim 2 wherein said manually engageable means further includes a spring for spring biasing said movable locking member.

4. A push dagger as recited in claim 3 wherein said outer peripheral configuration and said inner peripheral configuration are both rectangular configurations.

5. A push dagger as recited in claim 2 wherein said movable locking member comprises a movable, cantilever spring locking member.

6. A push dagger as recited in claim 5 wherein said manually engageable means further includes means for fixedly securing one longitudinal end of said movable, cantilever spring locking member to an end portion of said blade and wherein the other, opposite, longitudinal end of said movable, cantilever spring locking member is both movable relative to said end portion of said blade and movable into and outside of said recess formed in said handle.

7. A push dagger as recited in claim 6 wherein the configuration of said end portion of said blade is in the form of a stepped, "U" shaped, elongated channel having a longitudinal axis disposed parallel to the longitudinal axis of said blade.

8. A knife comprising an elongated, generally planar, knife blade having first and second, oppositely disposed longitudinal ends and at least one sharpened knife edge of a continuous curvature extending along a substantial portion of the length of said blade and forming a sharpened knife point at said first longitudinal end of said blade, an elongated knife handle having first and second oppositely disposed longitudinal ends and means for interconnecting said blade and said handle along the length of said handle, said blade having a fully opened position and a fully closed position and being movable relative to said handle, said blade and said handle being physically disposed in the form of a "T" configuration when said blade is in its fully open position and being physically disposed in the form of an "I" configuration when said blade is in its fully closed position, said blade in its fully opened position comprising the vertically extending stem portion of said "T" configuration and said handle comprising the horizontally extending top or cross portion of said "T" configuration, said interconnecting means comprises manually engageable means for moving said blade and for releasably securing said blade in its fully opened position, said manually engaging means being fixedly secured to said blade at said second longitudinal end of said blade and extending movably outwardly from the plane of said blade to facilitate the manual engagement thereof.

9. A knife as recited in claim 8 wherein said manually engageable means includes a movable locking member having an outer peripheral configuration and wherein said handle includes interlocking means for releasably receiving and securely retaining said locking member in engagement therewith when said blade is in its fully opened position, said interlocking means having an inner peripheral configuration complementarily shaped to said outer peripheral configuration of said locking member to thereby prevent substantial relative movement between said blade and said handle when said blade is in its fully opened position.

10. A knife as recited in claim 9 wherein said interlocking means comprises a recess formed in said handle.

11. A knife as recited in claim 9 wherein said manually engageable means further includes a spring for spring biasing said movable locking member.

12. A knife as recited in claim 9 wherein said movable locking member comprises a movable, cantilever spring locking member.

13. A knife as recited in claim 12 wherein said manually engageable means further includes means for fixedly securing one longitudinal end of said movable, cantilever spring locking member to an end portion of said blade and wherein the other, opposite, longitudinal end of said movable, cantilever spring locking member is both movable relative to said end portion of said blade and movable within and outside of said recess formed in said handle.

14. A knife as recited in claim 13 wherein the configuration of said end portion of said blade is in the form of a stepped, "U" shaped, elongated channel having a longitudinal axis disposed parallel to the longitudinal axis of said blade.

15. A knife comprising an elongated, movable, sharpened knife blade, elongated means for receipt therein of said blade when said blade is in its fully closed position, said elongated means comprising an elongated knife handle, and interconnecting means for physically interconnecting said blade and said handle and for permitting relative movement between said blade and said handle, said blade having a longitudinal axis disposed parallel to the longitudinal axis of said handle when said blade is in its fully closed position and disposed perpendicularly to said longitudinal axis of said handle when said blade is in its fully opened position, said interconnecting means comprising manually engageable means for moving said blade and for releasably securing said blade in its fully opened position, said manually engageable means including a movable locking member having an outer peripheral configuration and a spring for spring biasing said movable locking member, said handle including interlocking means for releasably receiving and securely retaining said locking member in engagement therewith when said blade is in its fully opened position, said interlocking means having an inner peripheral configuration complementarily shaped to said outer peripheral configuration of said locking member to prevent substantial relative movement between said blade and said handle when said blade is in its fully opened position, said outer peripheral configuration and said inner peripheral configuration being both rectangular configurations, said interlocking means comprising a recess formed in said handle, said movable locking member comprising a movable, cantilever spring locking member, said manually engageable means further including means for fixedly securing one longitudinal end of said movable, cantilever spring locking member to an end portion of said blade and wherein the other, opposite, longitudinal end of said movable, cantilever spring locking member is both movable relative to said end portion of said blade and movable into and outside of said recess formed in said handle.

16. A knife as recited in claim 15 wherein the configuration of said end portion of said blade is in the form of a stepped, "U" shaped, elongated channel having a longitudinal axis disposed parallel to the longitudinal axis of said blade.

17. A knife comprising an elongated knife blade, an elongate knife handle and means for interconnecting said blade and said handle, said blade having a fully opened position and a fully closed position and being movable relative to said handle, said blade and said handle being physically disposed in the form of a "T" configuration when said blade is in its fully open position and being physically disposed in the form of an "I" configuration when said blade is in its fully closed position, said interconnecting means comprising manually engageable means for moving said blade and for releasably securing said blade in its fully opened position, said manually engageable means including a movable locking member having an outer peripheral configuration and a spring for spring biasing said movable locking member, said handle including interlocking means for releasably receiving and securely retaining said locking member in engagement therewith when said blade is in its fully opened position, said interlocking means having an inner peripheral configuration complementarily shaped to said outer peripheral configuration of said locking member to thereby prevent substantial relative movement between said blade and said handle when said blade is in its fully opened position, said interlocking means comprising a recess formed in said handle, said movable locking member comprising a movable, cantilever spring locking member, said manually engageable means further including means for fixedly securing one longitudinal end of said movable, cantilever spring locking member to an end portion of said blade and wherein the other, opposite, longitudinal end of said movable, cantilever spring locking member is both movable relative to said end portion of said blade and movable within and outside of said recess formed in said handle.

18. A knife as recited in claim 17 wherein the configuration of said end portion of said blade is in the form of a stepped, "U" shaped, elongated channel having a longitudinal axis disposed parallel to the longitudinal axis of said blade.

* * * * *